United States Patent [19]

Kawase et al.

[11] Patent Number: 5,010,744

[45] Date of Patent: Apr. 30, 1991

[54] METHOD OF CONSTRUCTING PLATING PILE KNIT FABRIC AND SINKER THEREFOR

[75] Inventors: Shinji Kawase; Shyozo Yorisue, both of Hyogo, Japan

[73] Assignee: Precision Fukuhara Works, Ltd., Japan

[21] Appl. No.: 464,242

[22] Filed: Jan. 12, 1990

[30] Foreign Application Priority Data

Mar. 13, 1989 [JP] Japan ..... 1-61434

[51] Int. Cl.[5] ..... D04B 9/12

[52] U.S. Cl. ..... 66/93; 66/107

[58] Field of Search ..... 66/93, 194, 107, 108, 66/136, 12

[56] References Cited

U.S. PATENT DOCUMENTS

| | | | |
|---|---|---|---|
| 1,901,751 | 3/1933 | Jones | 66/107 |
| 2,030,516 | 2/1936 | Lawson et al. | 66/107 |
| 2,050,962 | 8/1936 | Page | 66/107 |
| 2,436,318 | 2/1948 | McDonough | 66/136 |
| 4,020,653 | 5/1977 | Mishcon et al. | 66/93 |
| 4,194,374 | 3/1980 | Guell | 66/93 |
| 4,535,608 | 8/1985 | Plath et al. | 66/93 X |

FOREIGN PATENT DOCUMENTS

| | | | |
|---|---|---|---|
| 24618 | 2/1921 | France | 66/107 |
| 1280056 | 12/1986 | U.S.S.R. | 66/194 |
| 2085035 | 4/1982 | United Kingdom | 66/93 |

*Primary Examiner*—W. C. Reynolds
*Assistant Examiner*—John J. Calvert
*Attorney, Agent, or Firm*—Bell, Seltzer, Park & Gibson

[57] ABSTRACT

A method of constructing a plated pile knit fabric and sinker therefor is disclosed. The sinker is adapted for low pile formation in the construction of the plating pile knit fabric. Each sinker is obliquely movable from an advanced, lower position to a receded, upper position. A pile position control ledge extends horizontally with respect to the incline of the sinker. The distance between the sinker nose and sinker pile position control ledge is more extended than in a conventional sinker, and as a result, the sinker nose can be positioned lower than that in a conventional sinker so as to form low piles.

4 Claims, 4 Drawing Sheets

METHOD OF CONSTRUCTING PLATING PILE KNIT FABRIC AND SINKER THEREFOR

FIELD OF THE INVENTION

This invention relates generally to a method of constructing a plated pile knit fabric on a circular knitting machine and to the sinkers used thereon, and more particularly to such a method wherein the sinkers are obliquely movable and include a forward end portion having a throat to define a sinker nose positioned above the throat and a horizontally extending upper pile position control edge positioned rearwardly of the nose for engaging a pile yarn and a sinker top knitting ledge defined by a lower surface of the throat for engaging a ground yarn so as to properly position the ground yarn onto a knitting needle and ensuring plating of the fabric.

BACKGROUND OF THE INVENTION

In conventional single unit circular knitting machines, the sinkers include a nose which is in a high position thereon for knitting a plated pile fabric. The position of the nose and a control ledge on the sinker determines the desired length of the pile because as the pile yarn engages the nose and is caught thereon the yarn is spaced a set distance to the lower ledge defined by the sinker throat so as to establish the height of the formed pile. Typically, in a pile knitting machine, two yarns, a ground yarn and pile yarn, are fed during one cycle of a knitting operation. The two yarns serve as respective upper and lower yarns and are fed by means of appropriate yarn feeders and guides. In accordance with conventional methodology, the first yarn is fed to the needle while the second yarn is fed to the sinker top knitting ledge. Both yarns are caught by the needle hook when the sinker is pushed forward. The lower yarn is received onto the sinker top knitting ledge and the upper yarn is received onto the sinker nose positioned above the sinker top knitting ledge so as to aid in forming the desired height of the plated pile fabric.

As the needle is lowered to a distance below the sinker top knitting ledge, the two yarns received on the sinker form two sinker loops which are spaced according to the vertical distance between the respective parts of the sinker into which the yarns are received. The sinker loop of the upper yarn becomes the pile knit loop and the lower yarn, commonly referred to as the ground yarn, forms the ground knit loop. To knit a plated pile fabric as described above, the ground yarn must be fed to the needle hook and moved by the advancing sinker against the inner side of the needle hook. Additionally, the pile yarn received onto the sinker nose must be retained on the outer side of the needle hook adjacent the latch by the sinker. To form the plated pile fabric, it is necessary to stably position both the pile yarn and ground yarn onto the needle hook.

In accordance with the prior art, three methods conventionally have been used for stable positioning of the ground yarn onto the inner side of the needle hook. In the first prior art method, the sinker includes a throat which forcibly pushes the ground yarn toward the inner side defined by the needle hook so as to position the yarn thereat to form the plated pile knit fabric. In the second method, one of two sinkers inserted into one sinker groove positions the ground yarn onto the inner side defined by the needle hook. The sinker forcibly pushes the yarn to force the yarn into a stable position against the inner side of the needle hook. In the third method, the sinker includes an inclined surface on a top portion thereof which engages the ground yarn to draw the yarn downward. The sinker moves back and forth in a radial direction of the cylinder and forcibly positions the ground yarn onto the inner side of the needle hook. As the ground yarn is forcibly pushed against the inner side of the needle hook, it is stably positioned thereat.

The first and second methods cause yarn breakage in many instances. Additionally, associated knots or lints can be knitted into the fabric to create unacceptable defects. Also, as the ground yarn is positioned on the inner side of the needle hook, it usually is brought into this position by the sinker throat so that the yarn is nipped or caught by the sinker throat and needle. Additionally, if the knit density or the type of yarn must be changed, a skilled operator must make the finite adjustments to the sinker cam for establishing the distance in which the sinker is pushed and for establishing the timing movement of the sinker. This manual operation typically takes a prolonged period and any mistake made in the adjustment of the sinker cam effects the plating property yielded by the pile and ground yarns. Typically, knitting bars also appear along the course direction of the knit. In the third method, the inclined surface of the sinker top knitting ledge pushes the ground yarn. This also can create knitting bars, especially when the distance the sinker travels is incorrectly adjusted.

SUMMARY OF THE INVENTION

It is therefor an object of this invention to provide a method of constructing a plating pile knit fabric where manual adjustment of the sinker cam for effecting changes to the travel distance of the sinker or timing thereof is not necessary when the knitting density or type of yarn is changed.

It is another object of this invention to provide a sinker for use on a circular knitting machine which is novel in shape and adapted to produce a plated pile knit fabric having low piles.

These and other objects and advantages of the present invention are accomplished by the method of constructing a plated pile knit fabric on a circular knitting machine which is adapted for feeding a ground yarn and a pile yarn. The knitting machine includes sinkers obliquely movable from an advanced, innermost lower position to a receded, outermost upper position for aiding in forming low piles during the construction of the knit fabric. Each sinker includes a forward end portion having a throat extending transversely inwardly thereat to define a sinker nose positioned above the throat. A substantially horizontally extending upper pile position control ledge is positioned rearwardly of the nose for engaging a pile yarn and determining a height of the formed pile yarn loop. A sinker top knitting ledge is defined by the lower surface of the throat for engaging a ground yarn and properly positioning the yarn onto a knitting needle and insuring plating of the knit fabric.

A ground yarn and pile yarn are fed to a raised, open latch needle having previously formed ground yarn loops and pile yarn loops positioned on the needle stem. The needle is lowered so that the previously formed ground yarn loops and pile yarn loops retained on the needle rise on the needle stem and close the needle latch onto the ground and pile yarns fed thereto. Additionally, the sinker is obliquely advanced so that the pile yarn is received onto the upper pile position control ledge of the sinker. The ground yarn is received into the sinker throat and onto the sinker top knitting ledge. Both yarns are positioned higher than the hook of the needle.

The ground yarn is transferred to the inner side of the needle hook by further advancing the sinker as the needle is lowered so that the ground yarn received in the sinker throat is moved forwardly toward the inner side of the needle hook as the sinker advances. The needle is lowered to clear the previously formed ground and pile yarn loops from the needle while tightening the cleared loops with the sinker by advancing the sinker to the most advanced, innermost lower position. The needle is raised so that the formed pile and ground loops are transferred to the needle stem and the sinker is receded after the needle reaches a desired safety level so that as the needle is raised, the upper pile position control ledge and the sinker top knitting ledge is positioned lower than the needle hook. The formed pile loop received onto the pile position control ledge is then cleared therefrom.

BRIEF DESCRIPTION OF THE DRAWINGS

Other objects and advantages will appear as the description proceeds when taken in connection with the accompanying drawings, in which.

DETAILED DESCRIPTION OF THE PREFERRED EMBODIMENTS

Figure 1:
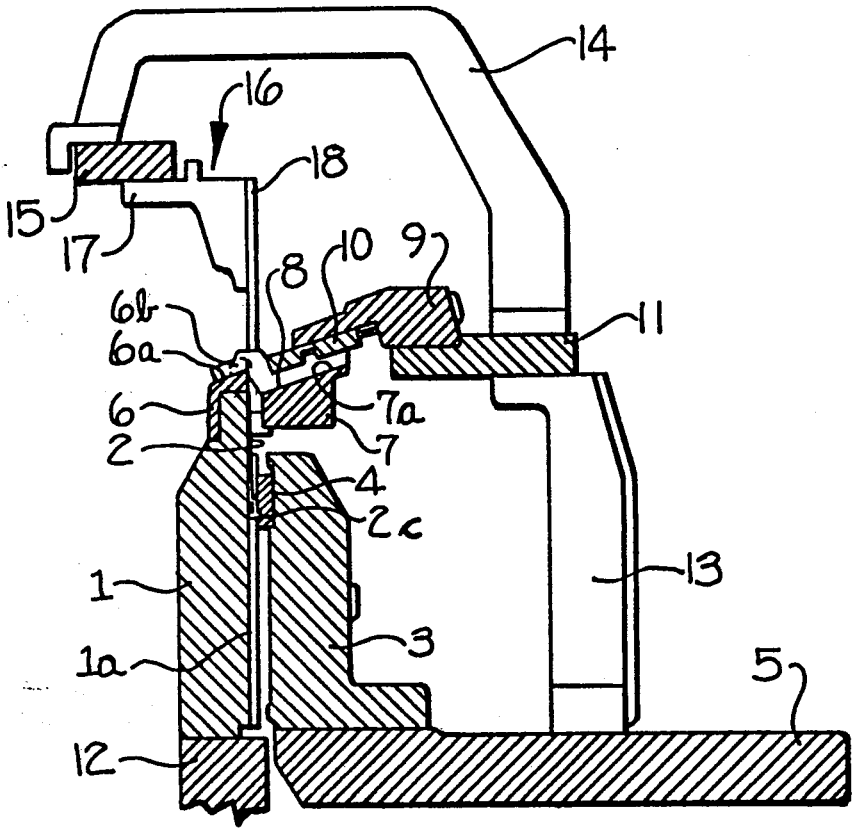
FIG. 1 is a vertical sectional view through the needle cylinder of the knitting machine and illustrating the manner in which the sinkers are mounted for radial sliding movement along a downwardly inclined path of travel relative to the needles.
Figure 4:
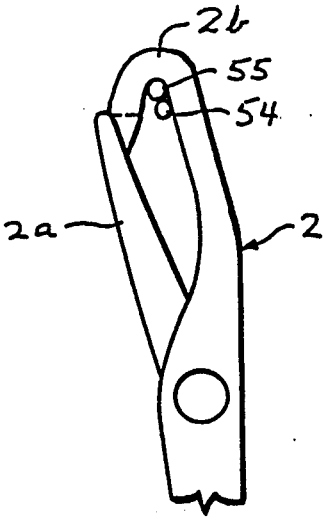
FIG. 4 is an enlarged side elevational view of the needle and showing the position of the ground and pile yarns caught therewithin.

As shown in FIG. 1, a rotating needle cylinder 1 is supported by a driven ring gear 12. The outside surface of the needle cylinder surface 1 is provided with the usual needle slots 1*a* in which hooked latch needles, broadly indicated at 2, are supported for vertical movement parallel to the axis of rotation of the needle cylinder 1. Each knitting needle is provided with a pivoted latch 2*a*, operating butt, as indicated at 2*c* (FIG. 1), and a hook 2*b* (FIG. 4). A conventional knitting control cam 4 is provided for engaging the butts 2*c* and imparting vertical movement to the knitting needles 2. The control cam 4 is supported on the inner surface of a cam holder ring 3 which is fixed on a cam ring plate 5.

A sinker nose support ring 6 is fixed on the upper inner surface of the needle cylinder 1 and is provided with a downwardly inclined surface 6*a* defined by the lower surfaces of sinker slots 6*b* provided in the upper end of the sinker nose support ring 6. A sinker support bed 7 is fixed to the exterior to the upper end of the needle cylinder 1 and is provided with a downwardly inclined sinker sliding surface 7*a* defined by the lower ends of sinker slots formed in the sinker bed 7 and at the same downwardly inclined angle as the sinker sliding surface 6*a* of the sinker nose ring 6.

Figure 2:
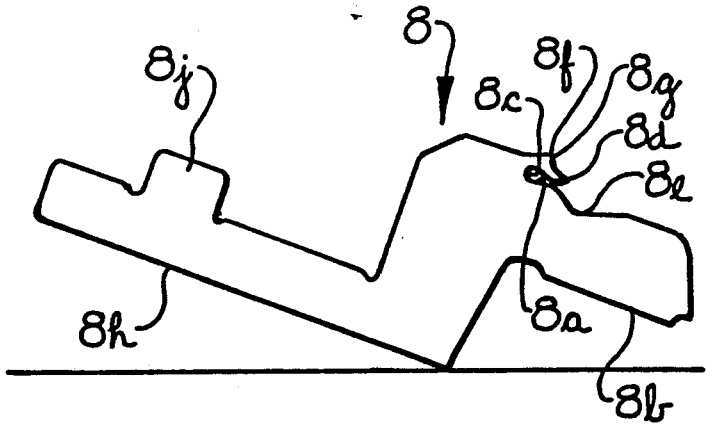
FIG. 2 is a side elevational view of one of the special type of sinkers utilized in the present invention.

Special types of sinkers, broadly indicated at 8 in FIG. 2, cooperate with the needles 2 to form knit loops and are supported for movement in a radial direction and along a downwardly inclined path of travel between the needles 2. The inward and outward radial sliding movement of the sinkers 8 along the downwardly inclined path of travel is controlled by sinker cams 10 supported in a fixed position on a sinker cap 9. The sinker cams 10 engage butts 8*j* on the sinkers to control the downwardly inclined inward and outward movement thereof. The sinker cap 9 is supported on a sinker cap ring 11 which is supported at spaced-apart locations on the upper ends of support standards 13 surrounding the needle cylinder 1. As Will be noted, the sinker cams 10 are supported in a downwardly inclined position at the same downwardly inclined angle as the inclined sliding surfaces 6*a* and 7*a* of respective nose ring 6 and sinker bed 7. The sinker sliding surfaces 6*a* and 7*a* are illustrated in FIG. 1 as being downwardly inclined at an angle of 20° relative to a line perpendicular to the vertically disposed needles 2. While this 20° downwardly inclined angle is preferred, the present invention is not limited to this particular angular inclination but may be positioned at an angle of from 5° to 60°, and preferably within the range of 10° to 45°.

As best seen in FIG. 2, the special sinker 8 in accordance with the present invention includes an elongate body portion having a main planer sliding edge 8*h* adapted to rest upon and slide along the inclined surface 7*a* of the sinker bed 7, and an inner lower additional planer sliding edge 8*b* adapted to rest on and slide along the inclined sliding surface 6*a* of the sinker nose ring 6. The forward end of the sinker includes a throat 8*c* extending transversely inwardly thereat to define a sinker nose 8*d* positioned above the throat and a substantially horizontally extending pile position control ledge 8*f* positioned rearwardly of the nose. Positioned forward to the pile position control ledge 8*f* is a vertical edge 8*g*. A sinker top knitting ledge 8*a* is defined by a lower surface of the throat, and as will be explained later in detail, engages a ground yarn to properly position the ground yarn onto a knitting needle for ensuring plating of the knit fabric. An upstanding operating butt 8*j* is provided on the outer end portion of the elongated body portion of the sinker 8. The butt 8*j* extends upwardly at a right angle from the body portion of the sinker 8 and is adapted to be engaged by the sinker cams 10 to impart the required inward and outward radial movement to the sinkers 8.

Figure 3:
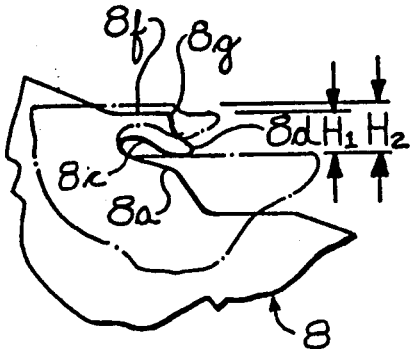
FIG. 3 is a fragmentary side elevational view of the forward yarn engaging end of the sinker in accordance with the present invention and showing schematically a comparison with a conventional type of sinker, the conventional type of sinker being shown in dashed-dot lines.

Referring now more particularly to FIG. 3, an enlarged view of the forward yarn engaging portion of the sinker 8 is illustrated. A conventional sinker is depicted in a dash-dot line configuration so as to compare the configuration of the conventional sinker and the sinker 8 in accordance with the present invention. As illustrated, the sinker top knitting ledge 8*a* declines with respect to the needle as compared to the more conventional sinker. Additionally, the pile position control ledge 8*f* which determines the height of the pile, extends horizontally in a manner similar to the conventional sinker. As illustrated, the vertical edge 8*g* and bending point of the nose 8*d* are positionally lower than the more conventional sinker. Thus, the distance from the bending point of the nose 8*d* to the pile position control ledge 8*f* is longer than that of the conventional sinker and permits the pile position control ledge 8*f* to be positioned correspondingly lower. In accordance with the present invention, a sinker height H1, i.e. the distance between the pile position control ledge 8*f* and the knitting face, i.e., sinker top knitting ledge 8*a*, can range under 1.4 millimeters, and more particularly, can range from 1.0 to 1.4 millimeters so as to insure low pile formation. A sinker height H2 of the more conventional sinker ranges approximately from 1.5 to 3.8 millimeters. The construction of the sinker in accordance with the present invention allows low pile formation during construction of the plated pile knit fabric.

Figure 5:
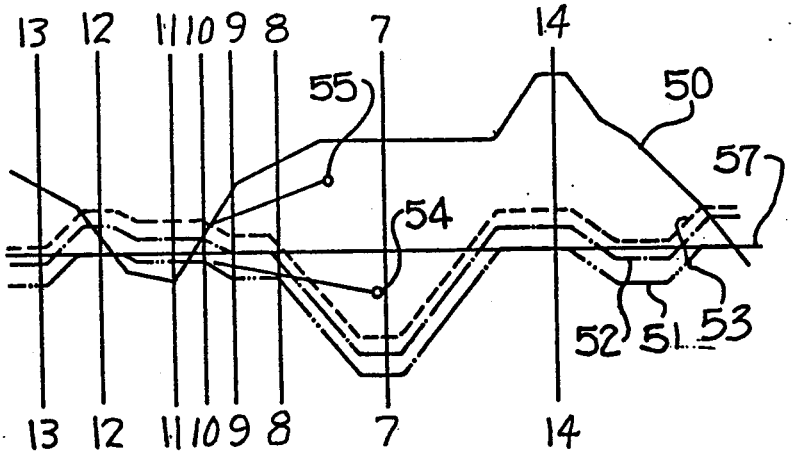
FIG. 5 is a somewhat schematic developed elevational view showing the paths of travel of the needles and the associated sinkers at the ground and pile yarn feeding positions.
Figure 6:
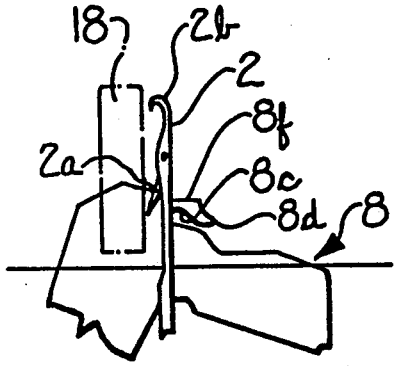
FIG. 6 is a fragmentary side elevational view of a needle and the forward yarn engaging end of an associated sinker.

Referring now more particularly to FIG. 5, a diagrammatic view illustrating the loci of movements of the cylinder needle and sinker on the knitting machine is shown. FIGS. 7 through 14 are sectional views taken along lines 7—7 through 14—14 in FIG. 5 and illustrate the knitting operation in accordance with the present invention. The solid horizontal transverse line 57 indicates the upper edge surface of the sinker nose ring 6. The continuous line 50 indicates the locus of movement of the hook tip 2*b* of needle 2. The alternate long and two dashed line 51 indicates the locus of movement of the sinker throat 8*c*. The alternate long and dashed line 52 indicates the locus of movement for tip of the pile position control ledge 8*f*. The dotted line 53 indicates the locus of movement of the sinker nose 8*d*. Reference numerals 54 and 55 indicate feeding positions of respective ground and pile yarns. The yarns 54, 55 are fed to the needles 2 by a respective yarn carrier 18 (FIGS. 1 and 6).

Method of Operation

Figure 8:
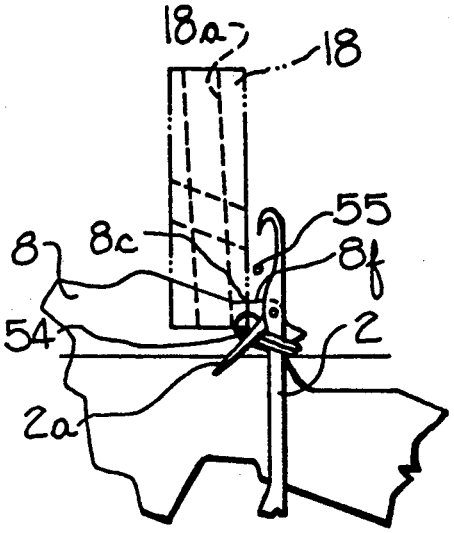
Figure 9:
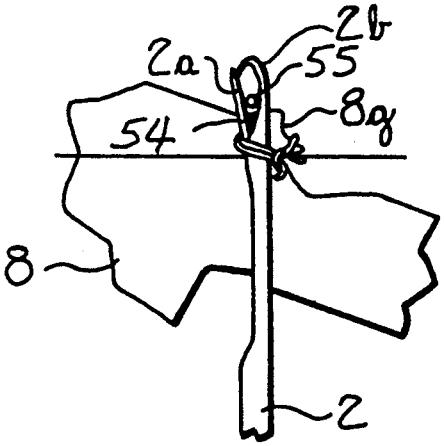
Figure 10:
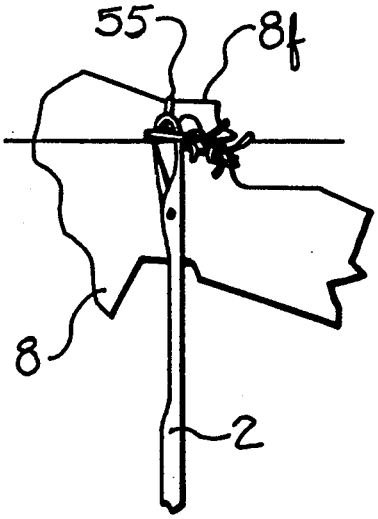
Figure 14:
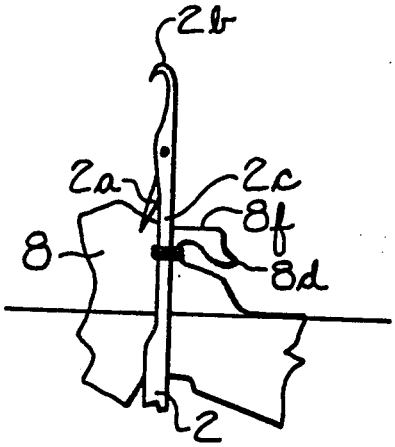

As the needles 2 successively approach the knitting station, they are successively raised to the clearing level along the solid line 50 in FIG. 5 to a position where the previously formed loops surrounding the shank of the needle are lowered below the tip of the latch (FIG. 14). As a needle 2 is lowered, the corresponding sinker 8 is moved inwardly and downwardly along the downwardly inclined path of travel between the needles so that the fabric is moved inwardly by the nose 8*d* to maintain the previously formed stitch loop below the tip of the latch 2*a* and in tight engagement with the shank of the needle as shown in FIG. 8. At this time, the ground yarn 54 is fed through the vertical hole 18*a* of the yarn carrier 18. The pile yarn 55 is fed through the transverse hole 18*b* when the needle is at the position shown between FIGS. 7—7 and 8—8 of FIG. 5 during its locus of movement. As the needle is lowered, the ground yarn 54 begins to turn to the closed position by the old loop on the needle shank. The ground yarn 54 is received into the sinker throat 8*c* and the pile yarn 55 is received onto the pile position control ledge 8*f* (FIG. 9).

Figure 11:
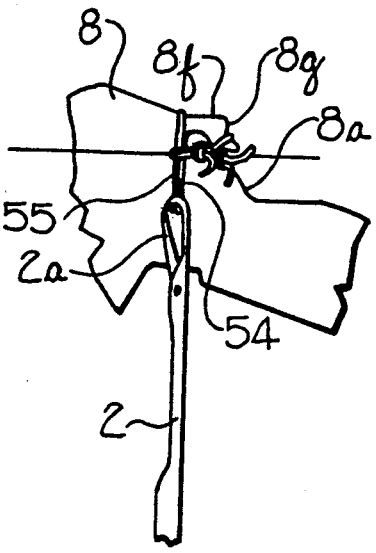

As the needle is lowered further, the old loops close the latch 2*a*. Both the ground yarn 54 received in the sinker throat 8*c* and the pile yarn 55 received onto the pile position control ledge 8*f* are caught by the needle hook 2*b*. As the needle is further lowered (FIG. 10), the pile yarn 55 is drawn downward by the needle. The sinker 8 advances in an inwardly declining direction and the ground yarn 54 is transferred to the inner side of the needle hook by the sinker top knitting ledge 8*a*. The advancing sinker 8 engages the ground yarn 54 and positions the yarn on the inner side of the needle hook in a more exact positional relationship with the pile yarn 55 positioned to the outer side in the needle hook (FIG. 4). When the needle is lowered to its lowermost position as shown in FIG. 11, the old loops are shed from the needle. At this point, the ground yarn 54 and the pile yarn 55 are lowered further and loops of respective yarns are formed in accordance with the desired loop length. The old loops cleared therefrom are tightened by the vertical edge 8*g* as the sinker advances.

Figure 12:
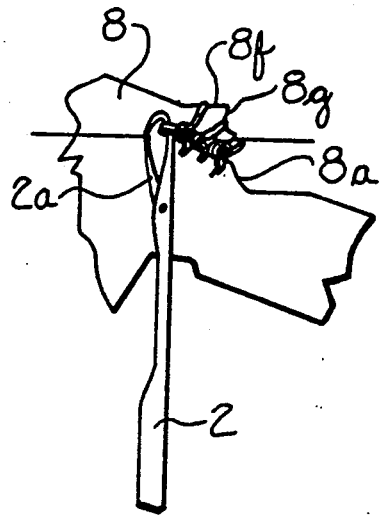
Figure 13:
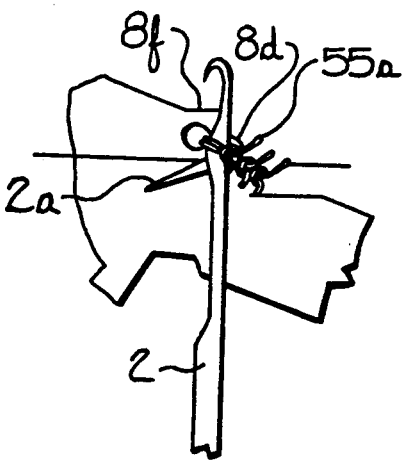

The needle 2 then is raised slightly (FIG. 12). When the needle rises, the loops held in the needle are slightly loosened. These loops are tightened by the sinkers 8 which advance to the most oblique, advanced position toward the inner side. The needle further rises (FIG. 13) and the loops held within the needle hook 2*b* pass the breast of the needle to open the latch 2*a*. The sinker recedes outwardly therefrom, and the pile loop 55 received onto the pile position control ledge 8*f* is cleared from the sinker nose 8*d* and drops therefrom. The sinker rises to its uppermost position (FIG. 14) and the loops which have passed along the breast of the needle 2 slide downwardly along the needle stem and over the tips of the latch 2*a*. At this point the needle has reached the highest position in the knitting operation.

Figure 7:
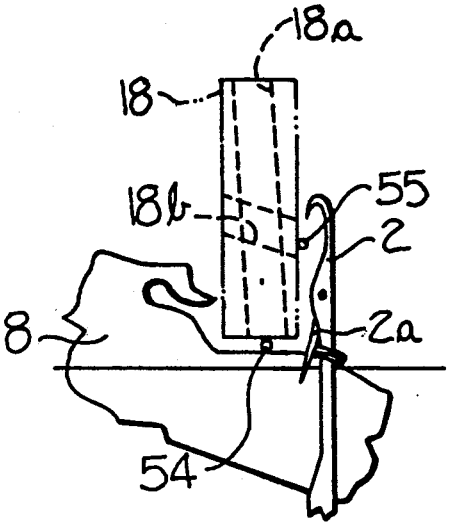
FIGS. 7–14 are side elevations of the upper portions of the needles and associated sinkers showing their relationship during the successive steps of forming the plated pile knit fabric in accordance with the present invention and the shedding of the previously formed ground and pile yarn loops from the needles, and being taken along the respective section lines 7–14 of FIG. 5.

When the needle is lowered, the loops on the needle stem are positioned inside of the latch 2*a* as shown in FIG. 7. Another cycle of the knitting operation is begun again. The yarn carrier 18 feeds a new ground yarn 54 and pile yarn 55 to begin again the knitting operation to construct the plated pile knit fabric. Alternatively, a compound needle instead of the preferred latch needle may be used with the requisite modifications made to the knitting machine as needed.

In accordance with the present invention, the oblique movement of the sinker enables exact positioning of the ground yarn and pile yarn toward the respective inner and outer sides of the inner space defined by the needle hook so that when the needle catches these yarns, the yarns are positioned in the needle to ensure proper construction of a plated pile knit fabric. The method in accordance with the present invention includes advantages over prior art methods which require the ground yarn to be pushed toward the inner side of the needle hook or a change in timing movement of the sinker each time the knitting density or kind of ground yarn is modified. Additionally, because the pile position control ledge 8*f* extends horizontally with respect to the inclination of the sinker in a manner similar to a conventional sinker, and the sinker top knitting ledge 8*a* declines with respect to the needle as compared to a more conventional sinker, the sinker height can range from 1.0 to 1.4 mm and the bending point between the pile position control ledge and the sinker nose can be positioned lower than that in the conventional sinker.

In the drawings and specification there has been set forth the best mode presently contemplated for the practice of the present invention. Although specific terms are employed, they are used in a generic and descriptive sense only and not for purposes of limitation, the scope of the invention being defined in the claims.

That which is claimed is:

1. A method of constructing a plated pile knit fabric on a circular knitting machine fitted for feeding a ground yarn and a pile yarn, with the knitting machine having sinkers obliquely movable from an advanced, innermost lower position to a receded, outermost upper position, and wherein each sinker includes a forward end portion having a throat extending transversely inwardly thereat to define a downwardly extending sinker nose positioned above the throat and a substantially horizontally extending upper pile position control ledge positioned rearwardly of the nose for engaging a pile yarn and determining the height of a formed pile yarn loop, and a sinker top knitting ledge surface defined by a lower surface of the throat for engaging a ground yarn and properly positioning the yarn onto a knitting needle and ensuring plating of the knit fabric, the method comprising the steps of (a) feeding a ground yarn and pile yarn to a raised, open latch needle hook having previously formed ground yarn loops and pile yarn loops positioned on the needle stem, (b) lowering the needle so that the previously formed ground yarn loops and the pile yarn loops rise on the needle stem and close the needle latch onto the ground and pile yarns fed thereto while also obliquely advancing the sinker so that the pile yarn is received onto the upper pile position control ledge of the sinker and the ground yarn is received into the sinker throat and onto the sinker top knitting ledge, and both yarns are positioned higher than the hook of the needle, (c) transferring the ground yarn to the inner side of the needle hook by further advancing the sinker as the needle is lowered so that the ground yarn received in the sinker throat is moved forwardly toward the inner side of the needle hook as the sinker advances, (d) lowering the needle to clear the previously formed ground and pile yarn loops from the needle while tightening the cleared loops with the sinker by advancing the sinker to the most advanced, innermost lower position, (e) raising the needle so that the formed pile and ground loops are transferred to the needle stem and receding the sinker after the needle reaches a desired safety level so that as the needle is raised, the upper pile position control ledge and the sinker top knitting ledge is positioned lower than the needle hook and the formed pile loop received onto the pile position control ledge is cleared therefrom, and wherein the sinker is obliquely moved so that the sinker top knitting ledge always intersects the needle obliquely whereas the pile position control ledge intersects the needle horizontally and is displaced upward when receding the sinker inwardly and displaced downward while advancing the sinker outwardly.

2. A method according to claim 1 wherein the sinker top knitting ledge declines inward as the sinker is advanced and the needle is lowered for positioning the ground yarn more inside the needle hook as the pile yarn and ground yarn are drawn downward by the pile position control part and the sinker top knitting ledge.

3. A sinker for use with knitting needles of a circular knitting machine and positioned for oblique movement relative to said knitting needles and forming low piles during the construction of a plated pile knit fabric from a ground yarn and a pile yarn, said sinker including a forward yarn engaging end having a throat extending inwardly thereat to define a downwardly extending sinker nose positioned above the throat and a substantially horizontally extending upper pile position control ledge positioned rearwardly of the nose, and a sinker top knitting ledge defined by a lower surface of the throat and which extends downwardly in a forward direction thereat, so that when said sinker is moved obliquely, said sinker top knitting ledge always intersects said needle obliquely, whereas said pile position control ledge intersects said needle horizontally and is displaced upward when receding said sinker inwardly and displaced downward while advancing said sinker outwardly.

4. A sinker as claimed in claim 3 wherein the distance between the upper surface of said pile position control ledge and said sinker top knitting ledge is between 1.0 and 1.4 mm for effecting low pile formation during knitting.

* * * * *